US008446242B2

(12) United States Patent
Harjes

(10) Patent No.: US 8,446,242 B2
(45) Date of Patent: May 21, 2013

(54) SWITCHABLE PERMANENT MAGNET AND RELATED METHODS

(75) Inventor: Daniel I. Harjes, Cambridge, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 19 days.

(21) Appl. No.: 12/797,217

(22) Filed: Jun. 9, 2010

(65) Prior Publication Data

US 2010/0328001 A1 Dec. 30, 2010

Related U.S. Application Data

(60) Provisional application No. 61/187,652, filed on Jun. 16, 2009.

(51) Int. Cl.
*H01F 7/20* (2006.01)
*B25B 11/00* (2006.01)

(52) U.S. Cl.
USPC ..... 335/285; 335/295; 269/8

(58) Field of Classification Search
USPC ..... 335/285–291, 295; 295/65.5; 269/8
See application file for complete search history.

(56) References Cited

U.S. PATENT DOCUMENTS

| | | | | |
|---|---|---|---|---|
| 2,637,115 | A | 5/1953 | Watson | |
| 2,733,949 | A | 2/1956 | Russell | |
| 3,108,163 | A | 10/1963 | Kripke | |
| 3,185,232 | A | 5/1965 | Iwasake | |
| 3,477,050 | A | 11/1969 | Hinger | |
| 3,604,959 | A | 9/1971 | Sturman | |
| 3,681,727 | A | 8/1972 | Hallmann | |
| 3,788,134 | A | 1/1974 | Meier | |
| 3,921,738 | A | 11/1975 | Schmidt | |
| 4,176,642 | A | 12/1979 | Shipinski | |
| 4,224,653 | A | 9/1980 | Daspit | |
| 4,329,673 | A | 5/1982 | Uchikune et al. | |
| 4,542,890 | A * | 9/1985 | Braillon | 269/8 |
| 6,029,541 | A | 2/2000 | Schrick et al. | |
| 6,076,873 | A * | 6/2000 | Jung | 294/65.5 |
| 6,707,360 | B2 | 3/2004 | Underwood et al. | |
| 6,765,465 | B2 | 7/2004 | Dunning et al. | |
| 7,049,919 | B2 * | 5/2006 | Yamaki | 335/288 |
| 7,095,305 | B2 * | 8/2006 | Shiao | 335/289 |
| 7,161,451 | B2 * | 1/2007 | Shen | 335/289 |
| 2001/0026204 | A1 * | 10/2001 | Petro | 335/229 |
| 2008/0223130 | A1 | 9/2008 | Snell et al. | |
| 2009/0027149 | A1 * | 1/2009 | Kocijan | 335/288 |
| 2011/0248806 | A1 * | 10/2011 | Michael | 335/295 |

FOREIGN PATENT DOCUMENTS

DE 3218943 A1 11/1983

* cited by examiner

*Primary Examiner* — Bernard Rojas

(74) *Attorney, Agent, or Firm* — Goodwin Procter LLP

(57) ABSTRACT

A mechanical linkage exerts a mechanical force on a permanent magnet to substantially counterbalance the magnetic force attracting the permanent magnet to a ferrous target surface.

24 Claims, 10 Drawing Sheets

SWITCHABLE PERMANENT MAGNET AND RELATED METHODS

CROSS-REFERENCE TO RELATED APPLICATION

This application claims priority to and the benefit of U.S. Provisional Patent Application No. 61/187,652, filed on Jun. 16, 2009, the entire disclosure of which is incorporated by reference herein.

GOVERNMENT SUPPORT

This invention was made with United States Government support under Contract No. N66001-08-2054 awarded by the Defense Advanced Research Projects Agency ("DARPA"). The United States Government may have certain rights in the invention.

TECHNICAL FIELD

The present invention relates, in various embodiments, to holding and releasing ferrous materials with a permanent magnet.

BACKGROUND

There are generally two forms of switchable magnetic devices. The first, and most popular, is the ferromagnetic-core electromagnet, which generates a magnetic field as current passes through a coil of wire surrounding a soft iron core. With proper driving electronics, electromagnets can efficiently transform electrical energy into magnetic energy. When electricity is no longer supplied to the magnet, the magnetic field dissipates (or appears in certain devices where an electromagnet is paired with a permanent magnet).

Some applications (e.g., retention and "pick-and-place" systems) are more suited to switchable magnets, but for various reasons (e.g., power, safety, etc.) electromagnets may not be preferred. For these situations, a second type of switchable magnetic device, which uses permanent magnets, may be employed. A typical device of this type has a primary permanent magnet with a flux path in direct contact with a ferrous target surface (usually steel). In the "engaged" state, the magnetic field from the primary magnet magnetizes the target surface and generates an attractive force. To disengage from the target surface, a secondary magnet may be positioned such that its magnetic field cancels that of the primary magnet at the surface, thereby eliminating or at least decreasing the attractive force between the magnet and the target material. There have been several variations to this approach (see, e.g., U.S. Pat. No. 6,707,360, the entire disclosure of which is incorporated by reference herein); however, they typically require a large amount of mechanical work to force the secondary magnet into the proper position to cancel the magnetic field of the primary magnet.

More generally, electromagnets and traditional switchable permanent magnets have several disadvantages. For example, electromagnets require electrical power, can be hazardous in lifting applications where power interruption is possible, and generally lose energy through joule heating in the coils. Traditional switchable permanent magnets are generally heavy and large, as they tend to require movement of multiple magnets relative to each other. Further, when a magnet is brought into contact with a target surface, the potential magnetic energy between them is lost to the surroundings as heat and noise during impact. This energy loss must be re-applied to the system to disengage the magnet, typically through mechanical work. This mechanical work may be substantial when the magnets are large.

Accordingly, a need exists for a system that maintains a strong attractive force to hold a target surface while minimizing the force required for disengaging the system from the target surface.

SUMMARY OF THE INVENTION

Generally, the invention relates to a quick and energy-conserving mechanism for holding and releasing ferrous materials with a permanent magnet. The mechanism may involve one or more mechanical linkages, such as a non-linear spring, coupled to the permanent magnet. The linkage (or linkages) exerts a mechanical force on the permanent magnet that counterbalances the magnetic force attracting the magnet to a target surface. For example, the mechanical linkage may be coupled to a frame that is drawn toward the target surface by a spring; magnetic potential energy (i.e., field energy) is converted to mechanical potential energy and vice versa according to Hooke's Law. This construction of a switchable permanent magnet device requires very little (i.e., theoretically zero) energy to engage or disengage the attractive force.

Commercially, the device described herein may be employed in connection with, for example, material handling applications (e.g., applications found in machine shops, in processing plants such as foundries and/or factories, in warehouses, in shipyards, etc.) and/or climbing applications (e.g., human and/or robotic climbing applications). In addition, the device described herein may be employed as an object holder in a variety of systems (e.g., in magnetic drill bases, as a manhole-cover lifter, etc.).

In one aspect, embodiments of the invention feature a switchable permanent magnet system. The system includes or consists essentially of a permanent magnet (that may include or consist essentially of neodymium) and a mechanical linkage; the linkage may be physically coupled to the permanent magnet. The mechanical linkage exerts a first mechanical force on the permanent magnet to substantially counterbalance the magnetic force attracting the permanent magnet to a ferrous target surface (that may include or consist essentially of a ferrous material (e.g., steel)). The mechanical linkage may, for example, include or consist essentially of a three-bar slider linkage connected to a linear mechanical spring and/or a non-linear mechanical spring. Further forms of the mechanical linkage may include or consist essentially of (i) a connecting rod, a crank, and/or a spring, or (ii) a spring, a track, and a follower. A surrounding frame may be coupled to the mechanical linkage. The surrounding frame may be drawn toward the ferrous target surface by a second mechanical force exerted by the mechanical linkage. A friction-reducing component for decreasing forces resisting movement of the permanent magnet may be used in embodiments with or without the surrounding frame. In one embodiment, the friction-reducing component may be a linear bearing in contact with the permanent magnet and the surrounding frame. In another embodiment, the friction-reducing component may be a roller bearing disposed between the permanent magnet and the surrounding frame. In an alternative embodiment the friction-reducing component may be a track roller system including or consisting essentially of a roller coupled to the permanent magnet and a track at a fixed location on the surrounding frame configured for rolling contact with the roller.

A tray may be coupled to the permanent magnet, and additional permanent magnets may be disposed within the tray. The permanent magnet and the additional permanent magnets may form a magnet array, which may be oriented such that on one side of the tray magnets with a first pole facing toward the side of the tray are disposed between magnets with the first pole facing away from the side of the tray.

The first mechanical force may restrict the permanent magnet from contacting the ferrous target surface. The exertion of the first mechanical force may be repeatable for a range of values of the magnetic force.

In another aspect, embodiments of the invention relate to a method for handling a ferrous material. The method includes or consists essentially of engaging the ferrous material using a permanent magnet and substantially counterbalancing an attractive magnetic force acting between the permanent magnet and the ferrous material with a mechanical force. The mechanical force promotes disengagement of the magnet from the ferrous material. In some embodiments, the ferrous material may be disengaged with substantially zero external work. The permanent magnet may be coupled to a surrounding frame, which is drawn toward the ferrous material by the mechanical force. The surrounding frame may at least partly counterbalance the magnetic force. The permanent magnet may not contact the ferrous material. If the permanent magnet does contact the ferrous material, the contact forces between them will be very low (or zero).

These and other objects, along with advantages and features of embodiments of the present invention herein disclosed, will become more apparent through reference to the following description, the figures, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
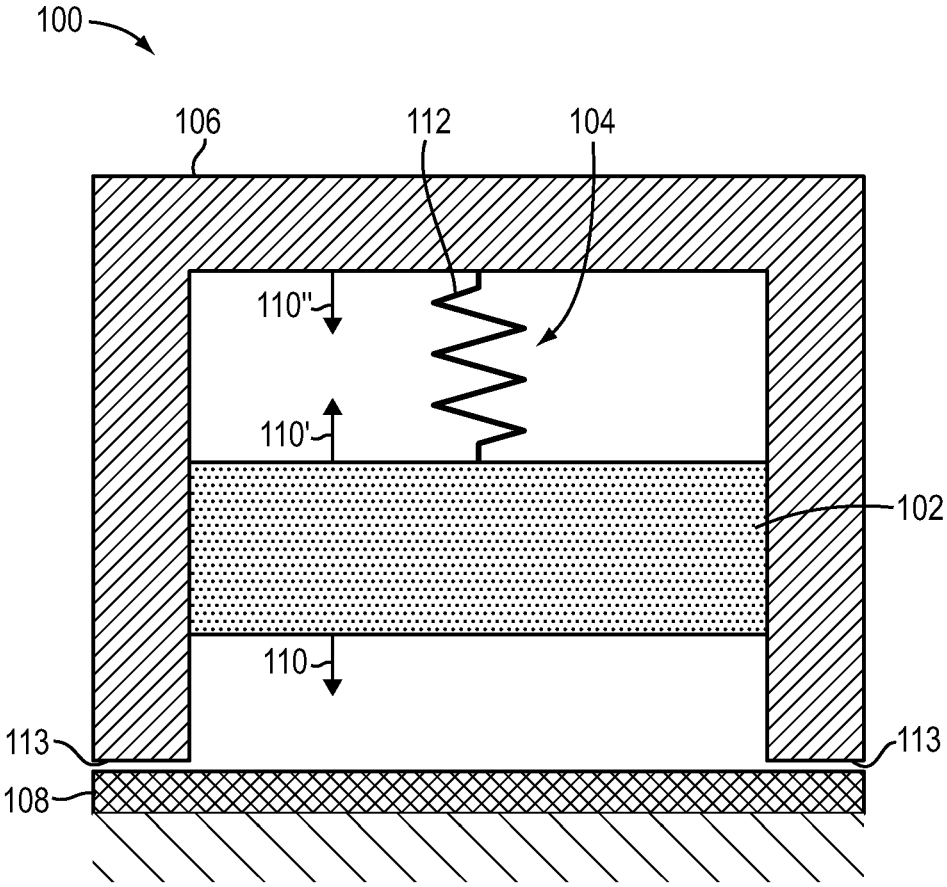
FIG. 1 is a schematic cutaway view of a switchable permanent magnet system in accordance with one embodiment of the invention.

In various embodiments, the present invention relates to a quick and energy-conserving approach to engaging and releasing a ferrous material. FIG. 1 depicts a switchable permanent magnet system 100 in accordance with one embodiment of the invention. As illustrated, the switchable permanent magnet system 100 includes a permanent magnet 102 coupled to one end of a mechanical linkage 104. An optional surrounding frame 106 is connected to the mechanical linkage 104. The switchable permanent magnet system 100 is depicted near a ferrous target surface 108.

The permanent magnet 102 may be any material that is magnetized, creating a constant magnetic field. This includes rare-earth magnets, such as neodymium- and samarium-cobalt-based magnets. The permanent magnet 102 may be any shape, including but not limited to a cylinder or a rectangular prism. The permanent magnet 102 is attached to the mechanical linkage 104 via an attachment mechanism, such as a high-strength adhesive, hooking system, or other fastening means. In the illustrated embodiment, the mechanical linkage 104 is a non-linear spring 112.

A magnetic force 110 is generated when the permanent magnet 102 and the ferrous target surface 108 are in proximity to each other. Typically, the surfaces of the permanent magnet 102 and the ferrous target surface 108 nearest each other will have opposite polarities, causing the magnetic force 110 to draw the permanent magnet 102 and the ferrous target surface 108 toward each other. The spring 112 is configured to counterbalance the magnetic force 110 by providing a mechanical force 110'. The mechanical force 110' is generated by the movement of the permanent magnet 102 as it either stretches or compresses the spring 112. Magnetic potential energy that is otherwise lost to the surroundings (typically as heat and noise) when the permanent magnet 102 is allowed to contact the ferrous target surface 108 in an unrestricted manner is instead conserved in the form of mechanical potential energy in the stretched spring 112.

At every distance away from the ferrous target surface 108, the magnetic force 110 is substantially balanced by the mechanical force 110' pulling the permanent magnet 102 away from the ferrous target surface 108. Thus, there is approximately zero net force on the permanent magnet 102 at all distances from the ferrous target surface 108. Because there is zero net force acting on the permanent magnet 102, and because of the stored mechanical energy in the spring 112, the permanent magnet 102 may be moved with little additional input. Some additional force may be required to translate the magnet because of potential frictional forces within the switchable permanent magnet system 100 and the difficulties in perfectly replicating a non-linear magnetic pull-force curve for the magnetic force 110. In one embodiment, a secondary mechanism may be used to adjust the mechanical force 110' based on a magnetic susceptibility of the ferrous target surface 108.

In various embodiments, the surrounding frame 106 is utilized. The surrounding frame 106 includes contact points 113 configured for contacting the ferrous target surface 108 and at least one portion configured for accepting the permanent magnet 102. This portion is ideally a complementary shape to that of the permanent magnet 102 to minimize resistance to movement by the permanent magnet 102. A free end of the spring 112 may be coupled to the surrounding frame 106 via a similar attachment method as discussed in regard to the permanent magnet 102. In this configuration, the permanent magnet 102 moves within the surrounding frame 106, either stretching or compressing the spring 112. When the permanent magnet 102 is placed near the ferrous target surface 108, the permanent magnet 102 tends to stretch the spring 112. At the same time that the spring 112 pulls on the permanent magnet 102 via the mechanical force 110', the spring 112 also pulls the surrounding frame 106 via a second mechanical force 110". The second mechanical force 110" is equal to the mechanical force 110', but acts in the opposing direction, thereby coupling the surrounding frame 106 to the ferrous target surface 108. When this coupling occurs, all of the contact forces are directed through the contact points 113.

Generally, the magnetic force 110 must be overcome to de-couple the surrounding frame 106 and the ferrous target surface 108. This is accomplished by moving the permanent magnet 102 away from the ferrous target surface 108, aided by the stored potential energy in the spring 112. The permanent magnet 102 typically moves in response to a relatively small input force when there are zero net forces acting on it. When the permanent magnet 102 is moved away from the ferrous target surface 108, the magnetic force 110 is greatly reduced, allowing the surrounding frame 106 to easily de-couple from the ferrous target surface 108.

Figure 2:
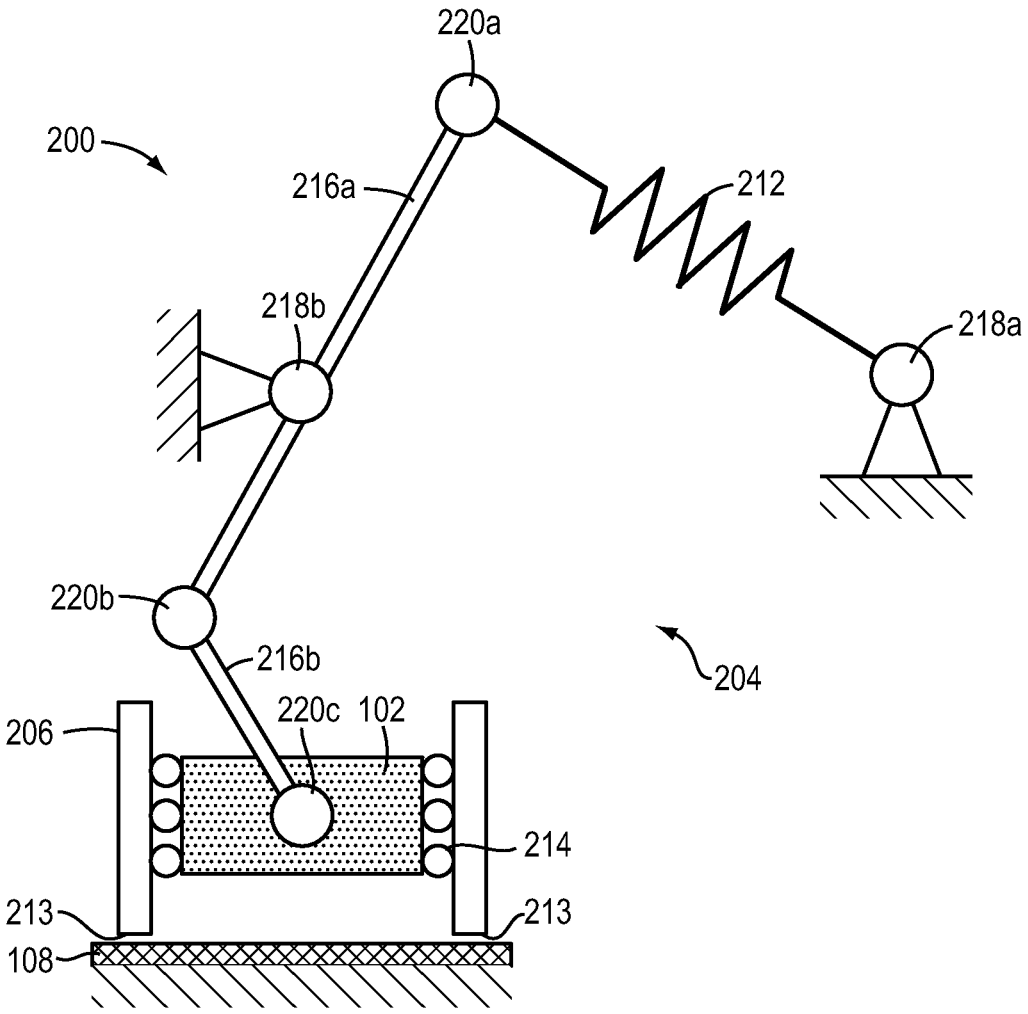
FIG. 2 is a schematic cutaway view of a switchable permanent magnet system in accordance with another embodiment of the invention.

FIG. 2 depicts an embodiment of a switchable permanent magnet system 200 with a permanent magnet 102, as previously described, and a mechanical linkage 204. Also shown are a portion of a surrounding frame 206, the ferrous target surface 108, and a friction-reducing component 214.

The mechanical linkage 204 includes a linear spring 212 and a three-bar slider linkage. The spring 212 serves a similar energy-storing function as the spring 112, but the spring 212 behaves in a substantially linear manner. (As used herein, the terms "substantially" and "approximately" generally connote ±10%, and in some embodiments, ±5%.) The non-linear force response is achieved through the three-bar slider linkage. The three-bar slider linkage includes first and second linkages 216*a*, 216*b*; first and second fixed pivots 218*a*, 218*b*; and first, second, and third free pivots 220*a*, 220*b*, 220*c*. The fixed pivots 218*a*, 218*b* retain their positioning relative to the system 200, whereas the free pivots 220*a*, 220*b*, 220*c* may translate within the system 200. The surrounding frame 206 may substantially surround the mechanical linkage 204, allowing the fixed pivots 218*a*, 218*b* to be fixedly connected to the surrounding frame 206 to retain their positioning.

The spring 212 is connected at one end to the first fixed pivot 218*a*. At the other end, the spring 212 is connected to the first linkage 216*a* at the first free pivot 220*a*. The first linkage 216*a* is secured to the second fixed pivot 218*b* at a point along its length. The first linkage 216*a* is connected to the second linkage 216*b* via the second free pivot 220*b* at an end of each of the linkages 216*a*, 216*b*. The second linkage 216*b* is coupled to the permanent magnet 102 at one end via the third free pivot 220*c*. Each connection may be by any fastening mechanism which allows rotation, including but not limited to a pin or a bolt.

The surrounding frame 206 is configured to allow the second linkage 216*b* to move freely across its width and the permanent magnet 102 to slide along a length thereof. The surrounding frame 206 may be rigidly connected to the fixed pivots 218*a*, 218*b*. The friction-reducing component 214 is generally positioned between the permanent magnet 102 and the surrounding frame 206 to reduce energy losses due to frictional forces while ensuring a consistent path of travel for the permanent magnet 102. The friction-reducing component 214 may comprise linear bearings or another mechanism capable of rolling or sliding motion.

The system 200 operates similarly to the system 100. This configuration also allows for a relatively weak linear spring 212 to generate a sufficiently large mechanical force 110' to balance the potentially large magnetic force 110. The surrounding frame 206 is brought into contact with the ferrous target surface 108 at contact points 213. When the magnetic fields of the permanent magnet 102 and the ferrous target surface 108 interact, the magnetic force 110 draws the permanent magnet 102 closer to the ferrous target surface 108. The permanent magnet 108 slides along the surrounding frame 206, aided by the friction reducing component 214. When this occurs, the second linkage 216*b* rotates toward an axis of the permanent magnet 102, in turn causing the first linkage 216*a* to rotate about the second fixed pivot 218*b*. The first free pivot 220*a* is forced away from the first fixed pivot 218*a*, stretching the spring 212. The spring 212 converts the magnetic potential energy into mechanical potential energy like the spring 112. To move the permanent magnet 102 away from the ferrous target surface 108, a minimal force opposing the magnetic force 110 may be applied directly to the permanent magnet 102 or any of the components of the mechanical linkage 204.

Figure 3A:
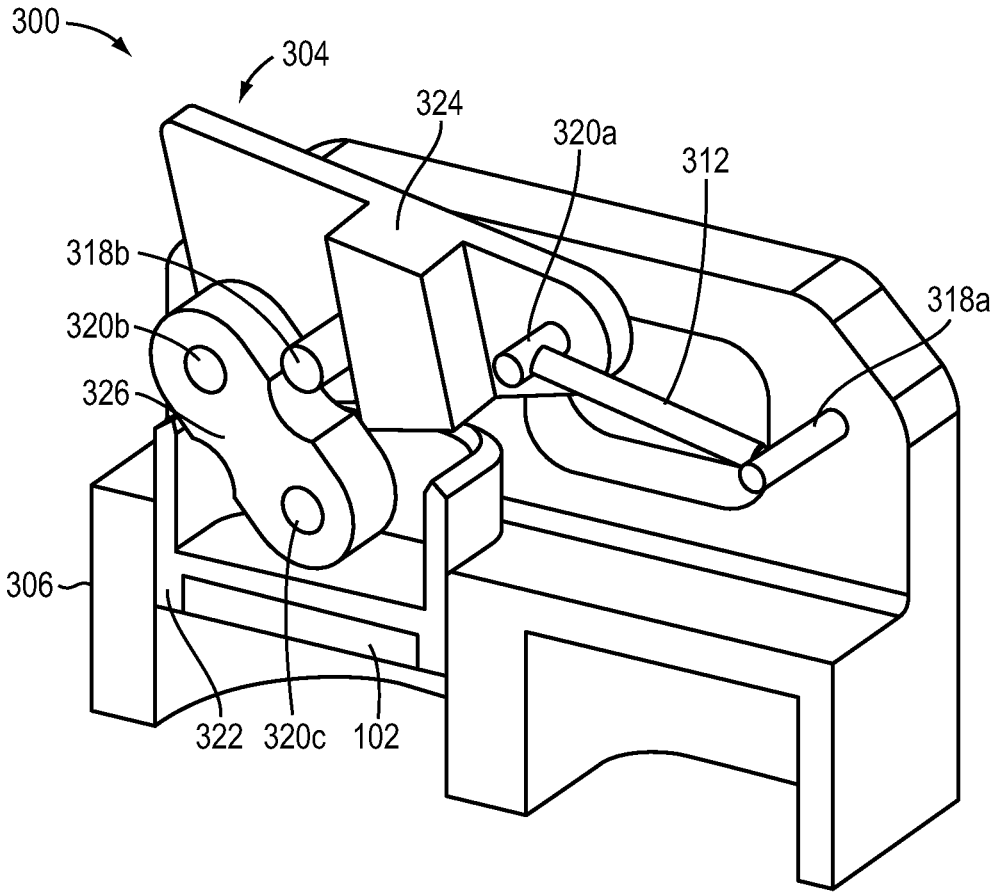
FIG. 3A is a schematic cutaway view of a switchable permanent magnet system in a disengaged position in accordance with one embodiment of the invention.
Figure 3B:
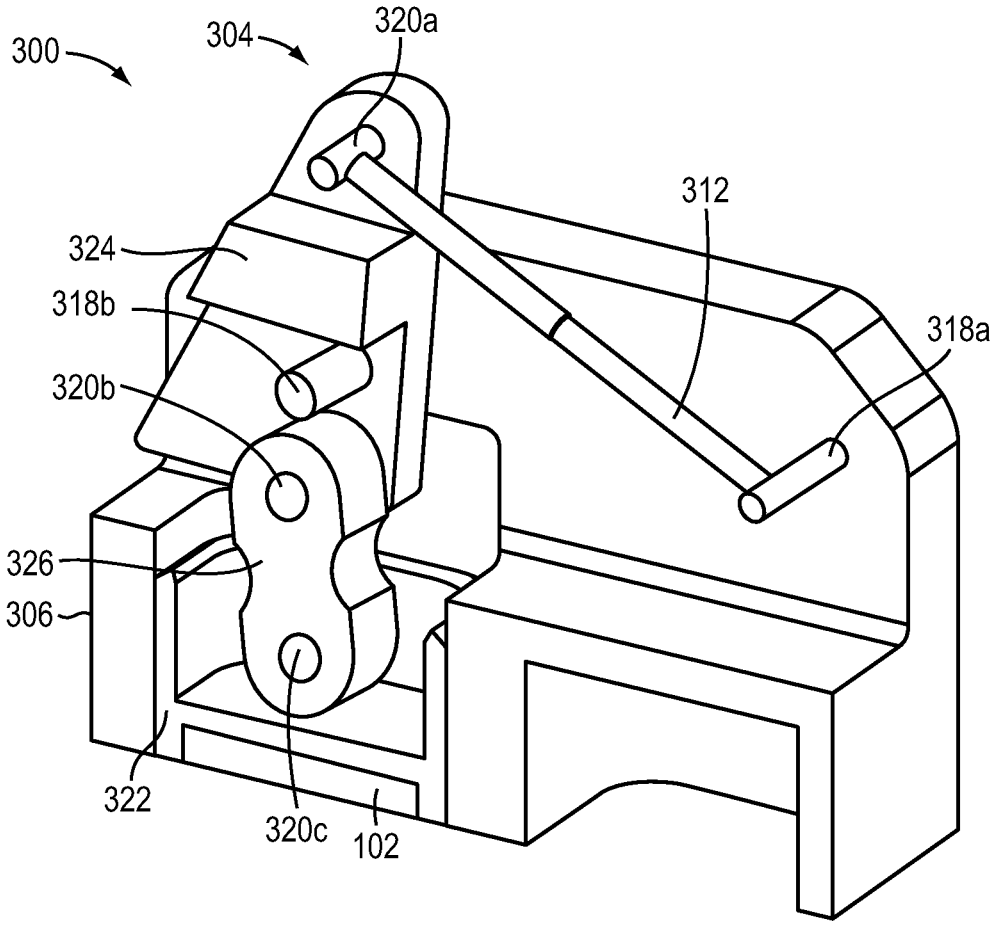
FIG. 3B is a schematic cutaway view of the system of FIG. 3A in an engaged position.

FIGS. 3A and 3B depict an embodiment of a switchable permanent magnet system 300 with a permanent magnet 102, as previously described, and a mechanical linkage 304. A segment of a surrounding frame 306 and a piston 322 are also shown.

The permanent magnet 102 is disposed on one end of the piston 322, exposed to the exterior of the surrounding frame 306. The piston 322 is configured to slidingly translate along a portion of the surrounding frame 306. The piston 322 may have a circular geometry to reduce potential binding points, although any complementary shapes that allow for the piston 322 to move relative to the surrounding frame 306 are contemplated.

The mechanical linkage 304 includes a linear spring 312; first and second fixed pivots 318*a*, 318*b*; first, second, and third free pivots 320*a*, 320*b*, 320*c*; a crank 324; and a connecting rod 326. The spring 312 is connected at one end to the fixed pivot 318*a* and at the other end to the crank 324 via the first free pivot 320*a*. The second fixed pivot 318*b* is disposed through the crank 324, providing a point about which the crank 324 may rotate. The connecting rod 326 is connected to the crank 324 via the second free pivot 320*b*. The connecting rod 326 is coupled to the piston 322 (and therefore the permanent magnet 102) via the third free pivot 320*c*. The connections may be made in the same way as described above in reference to the mechanical linkage 204.

The system 300 operates similarly to the previously described systems 100 and 200. In a disengaged state, as seen in FIG. 3A, the permanent magnet 102 is recessed from an exterior surface of the surrounding frame 306. FIG. 3B depicts the system 300 in an engaged state. The surrounding frame 306 is positioned on the ferrous target surface 108 (not shown in FIGS. 3A and 3B). When the permanent magnet 102 and the ferrous target surface 108 are located in close proximity to each other, the magnetic force 110 causes the permanent magnet 102 (and therefore the piston 322) to move toward the exterior of the surrounding frame 306. This movement pulls the third free pivot 320*c* and the connecting rod 326, causing the connecting rod 326 to rotate toward alignment with an axis of the permanent magnet 102. The movement and rotation of the connecting rod 326 moves the second free pivot 320*b*, thereby influencing the crank 324 to rotate about the second fixed pivot 318*b*. The rotation of the crank

324 forces the first free pivot 320*a* away from the first fixed pivot 318*a*, stretching the spring 312. The spring 312 stores the magnetic potential energy in the form of mechanical potential energy, ready to be used to help return the system 300 to the disengaged state. Engaging or disengaging the system 300 may occur by applying a small force to any of the components of the mechanical linkage 304 in support of the mechanical force 110'.

Figure 4:
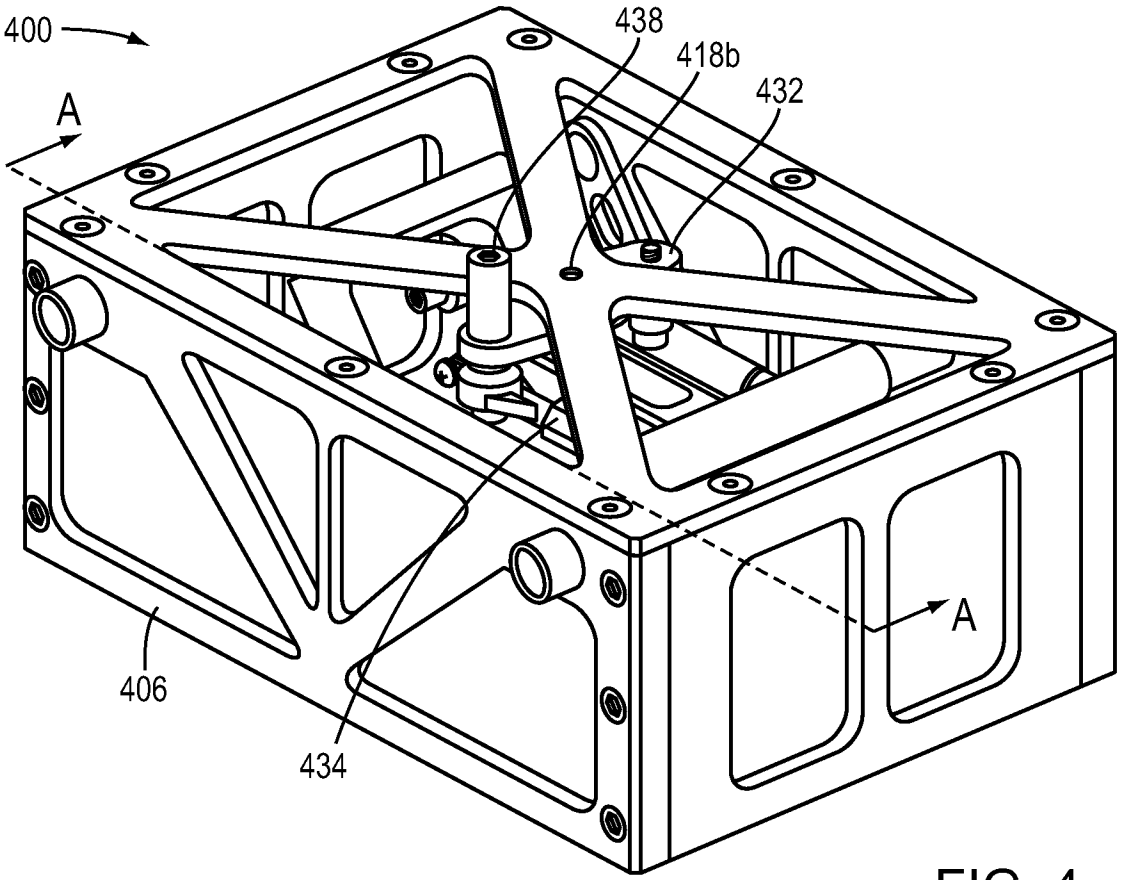
FIG. 4 is a perspective view of a switchable permanent magnet system in accordance with one embodiment of the invention.
Figure 5:
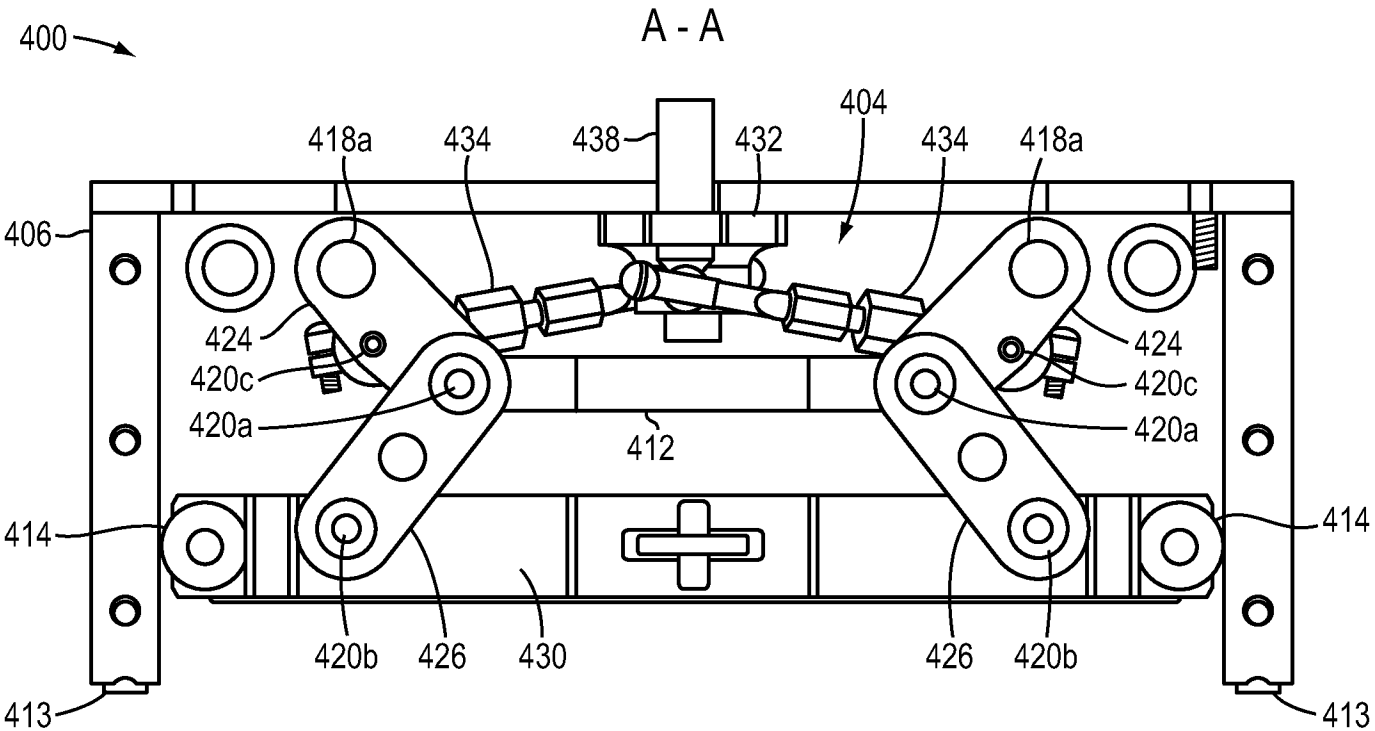
FIG. 5 is a schematic cutaway view of the system of FIG. 4, along the line A-A.

Another embodiment of a switchable permanent magnet system 400 is depicted in FIGS. 4 and 5. The system 400 includes larger permanent magnets 402 and smaller permanent magnets 402' (shown in FIG. 6), materially identical to the permanent magnet 102 previously described, and a mechanical linkage 404. Also included are a surrounding frame 406, a friction-reducing component 414, and a tray 430.

Figure 6:
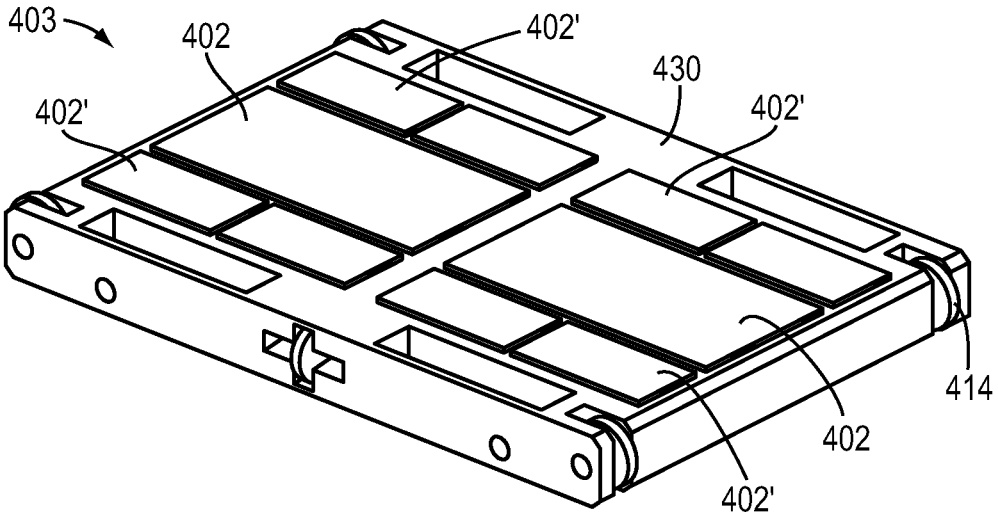
FIG. 6 is a perspective view of a tray and a magnet array for use with the switchable permanent magnet system of FIG. 4.

The permanent magnets 402, 402' may be disposed on the tray 430 as seen in FIG. 6. In the embodiment shown, the tray 430 includes six slots, four smaller slots and two larger slots. The larger slots are each formed between a pair of the smaller slots. Each of the slots is configured to accommodate at least one permanent magnet 402, 402'. The slots and permanent magnets 402, 402' may be closely dimensioned to provide a force fit, though alternate attachment methods, such as the use of a high-strength adhesive, may be used to secure the permanent magnets 402, 402'. The tray 430 also includes friction-reducing components 414 on its outer edges. The friction-reducing components 414 are in rolling contact with the surrounding frame 406, allowing the tray 430 to move along the interior of the surrounding frame 406 with minimal resistance. The friction-reducing components 414 may be any of a number of elements capable of lowering the resistance to moving the tray 430, including the rollers illustrated in FIGS. 5-7B.

Figure 7A:
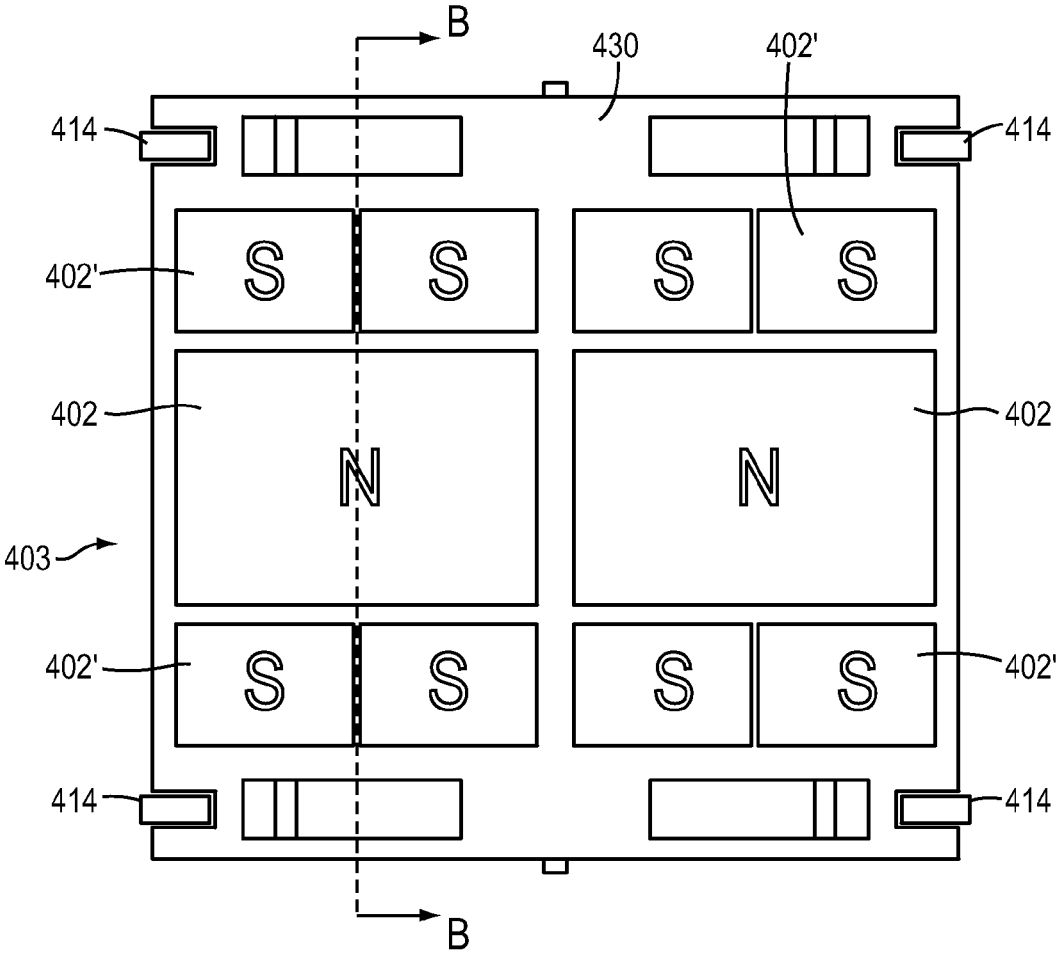
FIG. 7A is a schematic plan view of the tray and the magnet array of FIG. 6, illustrating the orientation of magnets in the magnet array.
Figure 7B:
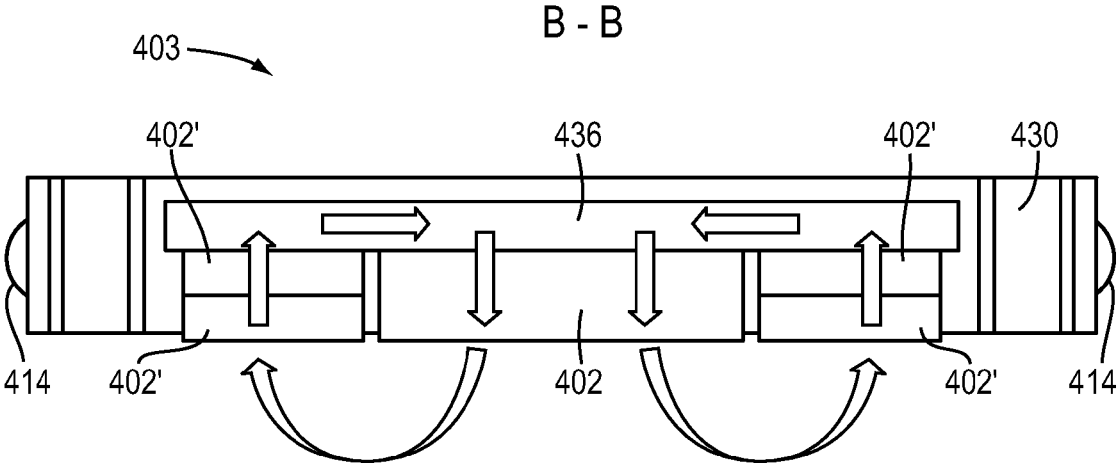
FIG. 7B is a schematic cutaway view of the tray and magnet array of FIG. 7A, along the line B-B, depicting a magnetic flux path generated by the magnet array.

The permanent magnets 402, 402' form a magnet array 403 when disposed within the tray 430. Because of the polarity of the permanent magnets 402, 402', the magnet array 403 will have different characteristics dependent upon the orientation of the permanent magnets 402, 402'. The orientation of one embodiment is shown in FIGS. 7A and 7B. In this embodiment, a large permanent magnet 402 occupies each of the larger slots, and the magnets 402 are each oriented such that on one side of the tray 430 the large permanent magnets 402 have the same polarity. Four smaller permanent magnets 402' are disposed within each of the smaller slots, and are placed such that their polarity is oriented in the direction opposite to the polarity of the larger permanent magnets 402. A plate 436 (which may include or consist essentially of steel or another ferrous material) is disposed within the tray 430 and is in contact with one side of the magnet array 403. The plate 436 completes the magnetic flux path generated by this configuration of the magnet array 403, as seen in FIG. 7B.

The mechanical linkage 404 includes a linear spring 412; first and second fixed pivots 418*a*, 418*b*; first, second, and third free pivots 420*a*, 420*b*, 420*c*; cranks 424; connecting rods 426; a crank coupler 432; crank-coupling rods 434; and a handle 438. Each end of the spring 412 is connected to one end of each crank 424 and one end of each connecting rod 426 via one of the first free pivots 420*a*. Another end of each of the cranks 424 is coupled to each first fixed pivot 418*a*. The tray 430 is connected to one end of each of the connecting rods 426 at the second free pivots 420*b*. The third free pivots 420*c* are located on the cranks 424 and connect to one end of each of the crank-coupling rods 434. The other ends of the crank-coupling rods 434 are connected to the crank coupler 432, which in turn is connected to a top portion of the surrounding frame 406 via the second fixed pivot 418*b*.

Again, the system 400 operates similarly to previously described systems 100, 200 and 300. The surrounding frame 406 is placed against the ferrous target surface 108 (not shown) at contact points 413. When the magnetic flux of the magnet array 403 begins to interact with the magnetic field of the ferrous target surface 108, the attractive magnetic force 110 draws the magnet array 403 toward the ferrous target surface 108. The tray 430 is drawn along with the magnet array 403, sliding along the surrounding frame 406 while aided by the friction-reducing components 414. The connecting rods 426 rotate toward a plane perpendicular to the magnet array 403, further separating the first free pivots 420*a* and stretching the spring 412. The cranks 424 likewise rotate toward a plane perpendicular to the magnet array 403, forcing the third free pivots 420*c* to move further apart and pulling each crank-coupling rod 434 toward a side of the surrounding frame 406. When the crank-coupling rods 434 are pulled, the crank coupler 432 rotates about the second fixed pivot 418*b*, translating the handle 438. The handle 438 may be manipulated back toward its original position to raise the magnet array 403, thereby disengaging the system 400.

Figure 8:
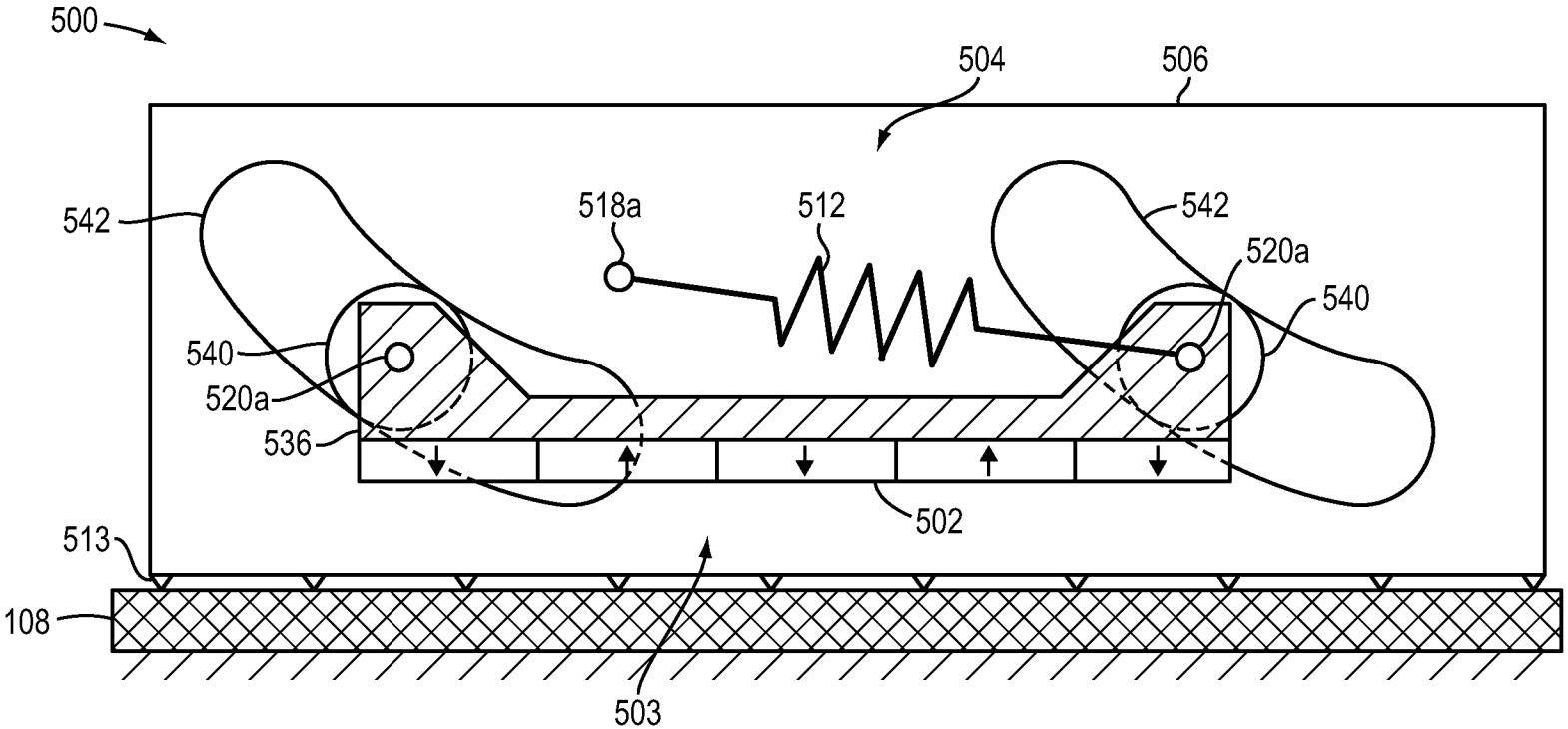
FIG. 8 is a schematic cutaway view of a switchable permanent magnet system in accordance with one embodiment of the invention.

Another switchable permanent magnet system 500 in accordance with various embodiments of the invention is seen in FIG. 8. The system 500 includes permanent magnets 502, a mechanical linkage 504, and a surrounding frame 506. The ferrous target surface 108 is also shown.

The permanent magnets 502 may be identical to the permanent magnet 102 previously described, and may form a magnet array 503. Each permanent magnet 502 in the magnet array 503 is oriented such that no permanent magnets 502 sharing a common edge have the same polarity orientation. Alternative orientations of the permanent magnets 502 in the magnet array 503 may be utilized, however these may not be as efficient for generating a magnetic field. A plate 536 (which may include or consist essentially of a ferrous material such as steel) is disposed on one side of the magnet array 503 and contacts each permanent magnet 502.

The mechanical linkage 504 includes a linear spring 512, a first fixed pivot 518*a*, first free pivots 520*a*, the steel plate 536, followers 540, and tracks 542. One end of the spring 512 is connected to the surrounding frame 506 via the first fixed pivot 518*a*. Another end of the spring 512 is connected to the steel plate 536. The spring 512 may be substantially horizontal in an initial configuration such that the spring 512 exerts a force in a predominately horizontal direction. The first free pivots 520*a* are located near corners of the steel plate 536 to connect to the followers 540. Each follower 540 is configured to follow one of the tracks 542, which may be formed in the structure 506 or added on separately. The followers 540 may be configured for rolling motion, and may be track rollers.

The surrounding frame 506 may include several contact points 513 along a surface thereof. The contact points 513 may be modified based upon the desired application for the system 500. For example, in an application where large shear loads must be supported, the contact points 513 may be very hard points or chisel blades. The contact points 513 are preferably able to penetrate the ferrous target surface 108, greatly increasing the coefficient of friction therebetween.

The system 500 operates in the same basic manner as the previously described systems 100, 200, 300, 400. Initially, the surrounding frame 506 is placed on the ferrous target surface 108, such that the magnet array 503 is facing the ferrous target surface 108. When the magnet array 503 is near the ferrous target surface 108, the attractive magnetic force 110 between the two draws the magnet array 503 toward the ferrous target surface 108. As in other embodiments, the movement of the magnet array 503 (and thus the plate 536), tends to stretch the spring 512. However, in the system 500, the movement of the magnet array 503 is restricted to the path dictated by the tracks 542. The tracks 542 are configured to complement the spring 512 in mirroring the pull-force curve of the magnetic force 110 by dictating the distance between the magnet array 503 and the ferrous target surface 108. As the magnet array 503 approaches the ferrous target surface 108, the magnetic force 110 coupling the surrounding frame 506 and the ferrous target surface 108 becomes larger. However, the net force on the magnet array 503 is still approximately zero and the magnetic force 110 may easily be decreased by applying a small force to the magnet array 503 or another component of the mechanical linkage 504 to increase the distance between the magnet array 503 and the ferrous target surface 108. This allows the surrounding frame 506 and the ferrous target surface 108 to be decoupled.

In an alternate embodiment, the system 500 utilizes components having circular cross-sections, e.g., cylindrical components. In such a configuration, the magnet array 503 and the plate 536 are circular and there are at least three followers 540 extending radially from a perimeter of the plate 536. The surrounding frame 506 is similarly cylindrical and defines at least three tracks 542 along a circumference thereof. The tracks 542 are angled and may be shaped like a ramp. The spring 512 is a torsional spring and is connected to the surrounding frame 506 and the plate 536. When the magnet array 503 moves toward the exterior of the surrounding frame 506, the tracks 542 cause the magnet array 503 and the plate 536 to rotate, stretching the spring 512. Because of this guided rotational movement, the need for most pivot connections is eliminated. Besides these noted differences, the principles and operation of the alternative embodiment are similar to the system 500 with non-cylindrical components described above.

In any of the previous embodiments, a custom mechanical linkage that accurately counters the magnetic force 110 may be designed by first determining a close approximation of the pull-force curve for the magnetic force 110. This may be done by fabricating a magnetic plate that mimics the behavior of the permanent magnet (e.g., permanent magnet 102) or the magnet array (e.g., magnet array 403) to be used. This magnetic plate may then be placed at various distances away from a typical target surface (e.g., a steel plate), and the resulting magnetic force measured. For example, one end of the magnetic plate may be coupled to a force-displacement instrument, such as one available from Instron (Norwood, Mass.). The measurements of the force at various distances may then be imported into a two-dimensional dynamic analysis software package, such as Working Model™ from Design Simulation Technologies (Canton, Mich.), or other mathematical software, such as Matlab™ from The MathWorks (Natick, Mass.). This software may be used to optimize the design of the geometry of the mechanical linkage 204, 304, 404, 504 and to determine an optimal spring constant for the springs 112, 212, 312, 412, 512 to match the force-distance data through direct closed-form solutions or goal-seeking optimization routines.

The various components utilized in the device described herein may be metal and/or any type of polymer with suitable compliancy and resiliency characteristics. Polyurethane, polypropylene, PVC, and others, are contemplated for use, as are aluminum and other metals.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A switchable permanent magnet system comprising:

a permanent magnet; and a mechanical linkage, moveable within an operating range, for exerting a first mechanical force on the permanent magnet to substantially counterbalance a magnetic force attracting the permanent magnet to a ferrous target surface so that there is approximately zero net force on the permanent magnet when the permanent magnet is placed at any distance from the ferrous target surface and is within the operating range of the mechanical linkage.

2. The switchable system of claim 1 further comprising a friction-reducing component for decreasing forces resisting movement of the permanent magnet.

3. The switchable system of claim 1, wherein the mechanical linkage is coupled to the permanent magnet, and further comprising a surrounding frame coupled to the mechanical linkage.

4. The switchable system of claim 3, wherein the surrounding frame is drawn towards the ferrous target surface by a second mechanical force exerted by the mechanical linkage.

5. The switchable system of claim 3, further comprising a friction-reducing component for decreasing forces resisting movement of the permanent magnet.

6. The switchable system of claim 5, wherein the friction-reducing component comprises a linear bearing in contact with the permanent magnet and the surrounding frame.

7. The switchable system of claim 5, wherein the friction-reducing component comprises a roller bearing disposed between the permanent magnet and the surrounding frame.

8. The switchable system of claim 5, wherein the friction-reducing component comprises a track roller system comprising:

a roller coupled to the permanent magnet; and a track at a fixed location on the surrounding frame configured for rolling contact with the roller.

9. The switchable system of claim 1, wherein the first mechanical force restricts the permanent magnet from contacting the ferrous target surface.

10. The switchable system of claim 1, wherein the mechanical linkage comprises a non-linear mechanical spring.

11. The switchable system of claim 1, wherein the mechanical linkage comprises a three-bar slider linkage coupled to a linear mechanical spring.

12. The switchable system of claim 1, wherein the mechanical linkage comprises at least one of a connecting rod, a crank, or a spring.

13. The switchable system of claim 1, wherein the mechanical linkage comprises a spring, a track, and a follower.

14. The switchable system of claim 1, further comprising a tray coupled to the permanent magnet.

15. The switchable system of claim 14, further comprising a plurality of additional permanent magnets disposed within the tray.

16. The switchable system of claim 15, wherein the permanent magnet and the additional permanent magnets form a magnet array.

17. The switchable system of claim 16, wherein the magnet array is oriented such that the tray comprises magnets (i) with a first pole facing toward a first side of the tray and (ii) disposed between magnets with the first pole facing away from the first side of the tray.

18. The switchable system of claim 1, wherein the ferrous target surface comprises steel.

19. The switchable system of claim 1, wherein the permanent magnet comprises neodymium.

20. A method for handling a ferrous material, the method comprising:

engaging the ferrous material using a permanent magnet that is coupled to a mechanical linkage, the mechanical linkage being moveable within an operating range; and substantially counterbalancing an attractive magnetic force acting between the permanent magnet and the ferrous material with a first mechanical force exerted by the mechanical linkage so that there is approximately zero net force on the permanent magnet when the permanent magnet is placed at any distance from the ferrous material and is within the operating range of the mechanical linkage, thereby promoting disengagement of the ferrous material.

21. The method of claim 20, wherein the ferrous material is disengaged with substantially zero external work.

22. The method of claim 20, wherein the magnetic force is counterbalanced at least in part by a surrounding frame coupled to the mechanical linkage.

23. The method of claim 22, wherein the surrounding frame is drawn toward the ferrous material by a second mechanical force exerted by the mechanical linkage.

24. The method of claim 20, wherein the permanent magnet does not contact the ferrous material.

* * * * *